US005848319A

United States Patent [19]

Morigami et al.

[11] Patent Number: 5,848,319

[45] Date of Patent: Dec. 8, 1998

[54] APPARATUS DISCRIMINATING THE TRANSPORT CONDITION OF A RECORDING MEDIUM THROUGH A FIXING DEVICE BASED ON TEMPERATURE OF A FIXING ROLLER

[75] Inventors: Yuusuke Morigami, Toyohashi; Tetsuro Ito, Anjo, both of Japan

[73] Assignee: Minolta Co., Ltd., Osaka, Japan

[21] Appl. No.: 917,552

[22] Filed: Aug. 26, 1997

[30] Foreign Application Priority Data

Aug. 30, 1996 [JP] Japan ..... 8-229913

[51] Int. Cl.[6] ..... G03G 15/20

[52] U.S. Cl. ..... 399/22; 399/21; 399/68; 399/320

[58] Field of Search ..... 399/67–69, 22, 399/320, 328, 322, 21; 219/216

[56] References Cited

U.S. PATENT DOCUMENTS 4,512,649 4/1985 Derimiggio ..... 399/22

5,627,634 5/1997 Koh ..... 399/69

FOREIGN PATENT DOCUMENTS 6-89067 3/1994 Japan .

7-121053 5/1995 Japan .

*Primary Examiner*—Arthur T. Grimley

*Assistant Examiner*—Quana Grainger

*Attorney, Agent, or Firm*—McDermott, Will & Emery

[57] ABSTRACT

An image forming apparatus and a fixing device used therein capable of discriminating transport condition of a sheet in the fixing device without sheet sensors. The fixing device is provided with a fixing roller for heating unfixed toner borne on a sheet and fixing the toner onto the sheet. A temperature sensor is arranged for detecting the temperature of the fixing roller, which temperature sensor communicating with a controller of the image forming apparatus or the fixing device. The controller discriminates the transport condition of the sheet based on the temperature change of the fixing roller detected by the temperature sensor so as to execute varied control.

72 Claims, 4 Drawing Sheets

APPARATUS DISCRIMINATING THE TRANSPORT CONDITION OF A RECORDING MEDIUM THROUGH A FIXING DEVICE BASED ON TEMPERATURE OF A FIXING ROLLER

BACKGROUND OF THE INVENTION

1. Field of the Invention

The present invention relates to an image forming apparatus such as copier, printer, facsimile and the like for forming images on a recording medium such as plain paper and the like, and further relates to a fixing device used in said image forming apparatus.

2. Description of the Related Art

Conventional image forming apparatuses such as copiers, printers, facsimiles and the like generally are provided with a paper feeding device, image forming device, fixing device, paper discharge device and the like. In such image forming apparatuses, a recording sheet typically comprising a sheet of plain paper or the like sequentially passes through a sheet feeding device, image forming device, fixing device, and sheet discharge device, and is subjected to predetermined processing by each said device, after which the sheet is ejected from the image forming apparatus.

In order to subject the sheet to suitable processing by each of the various devices in the aforesaid image forming apparatus, the transport state of the sheet must be detected to control the various devices in accordance with the result of said detection.

Therefore, detectors are provided near the sheet feeding device, image forming device, fixing device, and sheet discharge device in conventional image forming apparatuses to detect a sheet as it passes each of said various devices. Each device is controlled in accordance with detection signals transmitted from the various detectors.

Since a sheet detector is provided at each device comprising the image forming apparatus, a first disadvantage arises inasmuch as the aforesaid image forming apparatus requires a plurality of detectors, thereby increasing the cost of the apparatus.

A sheet detector cannot be disposed in close proximity to some devices, and particularly fixing devices, due to the high temperature generally attained by the fixing device. Therefore, when a blockage such as a paper jam occurs within a fixing device, detection is delayed and the blockage becomes aggravated, and may possibly result in a blockage condition which cannot be cleared by the user. That is, when the discovery of a blockage such as a paper jam is delayed, a serious blockage may be induced which necessitates requesting a service by a technician with special skills, thereby causing a second disadvantage inasmuch as the image forming apparatus may be temporarily out of service.

Methods of placing heat-resistant detectors in close proximity to the fixing device have been considered as a means of eliminating the aforesaid second disadvantage. In this case, however, a third disadvantage of increased cost arises due to the high cost of the heat-resistant detector.

SUMMARY OF THE INVENTION

An object of the present invention is to eliminate the previously mentioned disadvantages by providing an improved image forming apparatus and fixing device.

A further object of the present invention is to provide an image forming apparatus and fixing device capable of preventing serious blockages from occurring while reducing cost by discriminating the transport condition of a recording medium (i.e., a sheet) using a temperature detector provided on the fixing device.

These objects are achieved by providing an image forming apparatus comprising:

1) a fixing device to heat and melt unfixed toner borne on a sheet and fix said toner on said sheet, said fixing device provided with:
   - a first rotating member which is freely rotatable,
   - a second rotating member which is freely rotatable and presses against said first rotating member to nip and transport a sheet between said first and second rotating members, and
   - a heater to heat said first rotating member;
2) a detector to detect the temperature of said first rotating member; and
3) a discriminating unit to discriminate the transport condition of said sheet in said fixing device based on the temperature of said first rotating member detected by said detector.

The discriminating unit in the aforesaid image forming apparatus determines that a sheet has been inserted into the fixing device when the temperature of said first rotating member is less than a predetermined first threshold value, and determines that said sheet has been ejected from said fixing device when the temperature of said first rotating member is greater than a predetermined second threshold value which is greater than said first threshold value.

The aforesaid discriminating unit determines a paper jam has occurred when a sheet has not been determined to have been ejected from the fixing device within a predetermined time period after a sheet has been determined to have been inserted in said fixing device. When a paper jam is determined, the fixing devices is stopped.

The aforesaid detector in the above-described image forming apparatus may be, for example, a thermistor which detects the surface temperature of the first rotating member. This detector is preferably disposed near the area of contact between the first and second rotating members on the downstream side therefrom in the sheet transport direction.

The aforesaid first rotating member in the above-described image forming apparatus may be, for example, a roller. In such a case, the aforesaid heater may be built into said roller.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

The preferred embodiments of the present invention are d scribed hereinafter with reference to the accompanying drawings.

Figure 1:
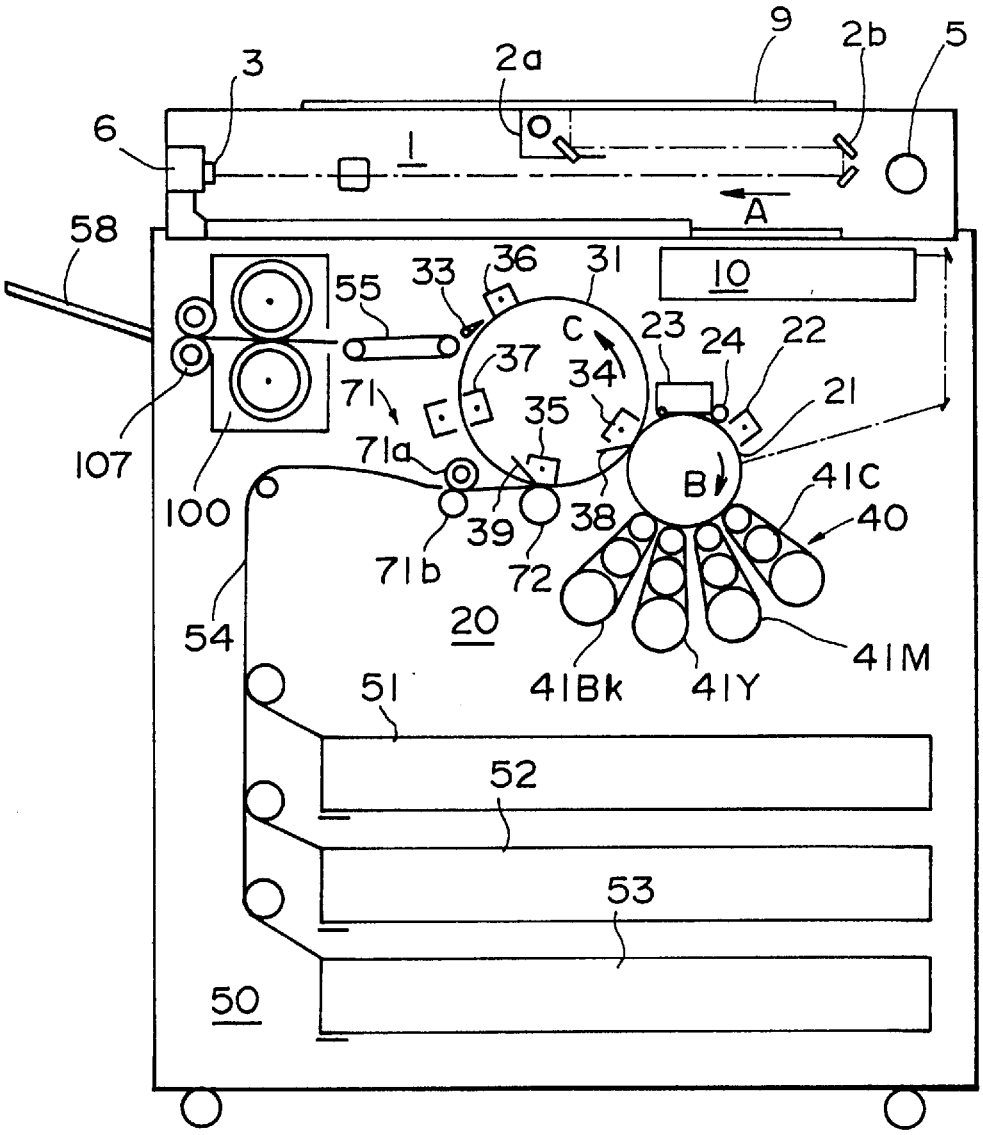
FIG. 1 briefly shows the construction of a copying machine as one mode of the image forming apparatus of the present invention.

FIG. 1 shows the general construction of a full color copier, as one incarnation of the image forming apparatus of the present invention. This copier briefly comprises a image reader unit 1, laser scanning unit 10, full color image forming unit 20, and sheet feeding unit 50.

Image reader unit 1 comprises scanners 2*a* and 2*b* to read the image of a document placed on a glass platen 9, and image signal processing unit 6 to convert read image data to print data.

Image reader unit 1 is a well-known image reader unit which is provided with a compact color image sensor (charge-coupled device; CCD) 3. Scanners 2*a* and 2*b* movably driven in the arrow A direction via a motor 5, and image sensor 3 reads the document image line by line as color signals of the three primary colors red (R), green (G), blue (B). The image signal processing unit 6 converts the multi-level electric signals photoelectrically converted by image sensor 3 to 8-bit print data corresponding to the four colors yellow (Y), magenta (M), cyan (C), and black (Bk), executes processing necessary for editing, and transmits said print data to laser scanning unit 10.

Laser scanning unit 10 is a well-known laser scanning unit which sequentially forms electrostatic latent images of each color on the surface of a photosensitive member drum 21 rotating in the arrow B direction by modulating a laser diode. Laser scanning unit 10 executes gradation correction on print data input from image signal processing unit 6 in accordance with the gradation characteristics of the photosensitive member, and thereafter subjects said corrected data to digital-to-analog (D/A) conversion to generate laser diode drive signals. Laser scanning unit 10 then forms sequential electrostatic latent images of the colors cyan, magenta, yellow, and black on the surface of photosensitive member drum 21 by modulating the laser diode based on said drive signals.

The full color image forming unit 20 comprises mainly photosensitive member drum 21 and transfer drum 31. Arranged sequentially around the periphery of photosensitive member drum 21 are a charger 22, developing unit 40 of a magnetic brush type, residual toner cleaner 23, and residual charge eraser lamp 24. Developing unit 40 is provided with developing devices 41C, 41M, 41Y, and 41Bk which accommodate developers containing cyan, magenta, yellow, and black color toner, respectively. The developing devices of developing unit 40 are driven when an electrostatic latent image of each color is formed on the surface of photosensitive member drum 21.

The transfer drum 31, which is a sheet-bearing member, comprises a dielectric film stretched in barrel shape around a frame. Transfer drum 31 is arranged so as to be rotatably driven in the arrow C direction at the same speed as photosensitive member drum 21, and the toner image is transferred onto a sheet wrapped around the surface of the transfer drum 31. This transfer drum 31 is provided with a chucking member (not illustrated) to lock the leading edge of the sheet and a separating member 33 to separate the sheet from the drum. The transfer charger 34 and transfer backup member 38, sheet adhering charger 35 and adhering backup member 39, sheet separation charger 36, discharger 37, and sheet adhering roller 72 opposite said sheet adhering charger 35 are arranged on the interior side and exterior side of the transfer drum 31. A timing roller 71 is positioned near the transfer drum 31. The timing roller 71 comprises rollers 71*a* and 71*b*.

Sheet feeding unit 50 is a tri-level unit provided with paper trays 51, 52, and 53, and feeds sheet by sheet from any of the paper trays 51, 52, or 53 selected by an operator. A fed sheet is transported through transport path 54 onto the transfer drum 31 via timing roller 71, and is electrostatically adhered to and wrapped around the surface of transfer drum 31 via discharge from the adhering charger 35 and pressure applied by sheet adhering roller 72.

When forming full color images, cyan, magenta, yellow, and black images are sequentially formed on the surface of photosensitive member drum 21. These toner images are sequentially transferred so as to be overlaid upon another on the sheet wrapped around transfer drum 31 via discharge from the transfer charger 34.

That is, a cyan electrostatic latent image is formed on the surface of photosensitive member drum 21 by the modulation and emission of a laser diode, and this latent image is developed by the cyan developing device 41C. The cyan toner image is transferred via a discharge from transfer charger 34 onto a sheet fed to transfer drum 31 via timing roller 71. The sheet bearing the transferred cyan image is rotated once together with transfer drum 31 while wrapped around said transfer drum 31 for the transfer of the next magenta image. In the mean time, a magenta electrostatic latent image is formed on the surface of photosensitive member drum 21 by the modulation and emission of the laser diode, and this latent image is developed by magenta developing device 41M. The magenta toner image is then transferred via discharge from transfer charger 34 onto the sheet rotated once while wrapped around the transfer drum 31 so as to be aligned with the previously transferred cyan image. Similarly, transfer drum 31 is rotated twice and yellow and black toner images are sequentially transferred onto the sheet.

When the four color images have been combined on the sheet, the sheet is separated from transfer drum 31 by operating the separating member 33. The separated sheet is transported to fixing device 100 by a transport belt 55, and the toner is fixed to the sheet, after which the sheet is ejected onto tray 58 by a discharge device 107.

Figure 2:
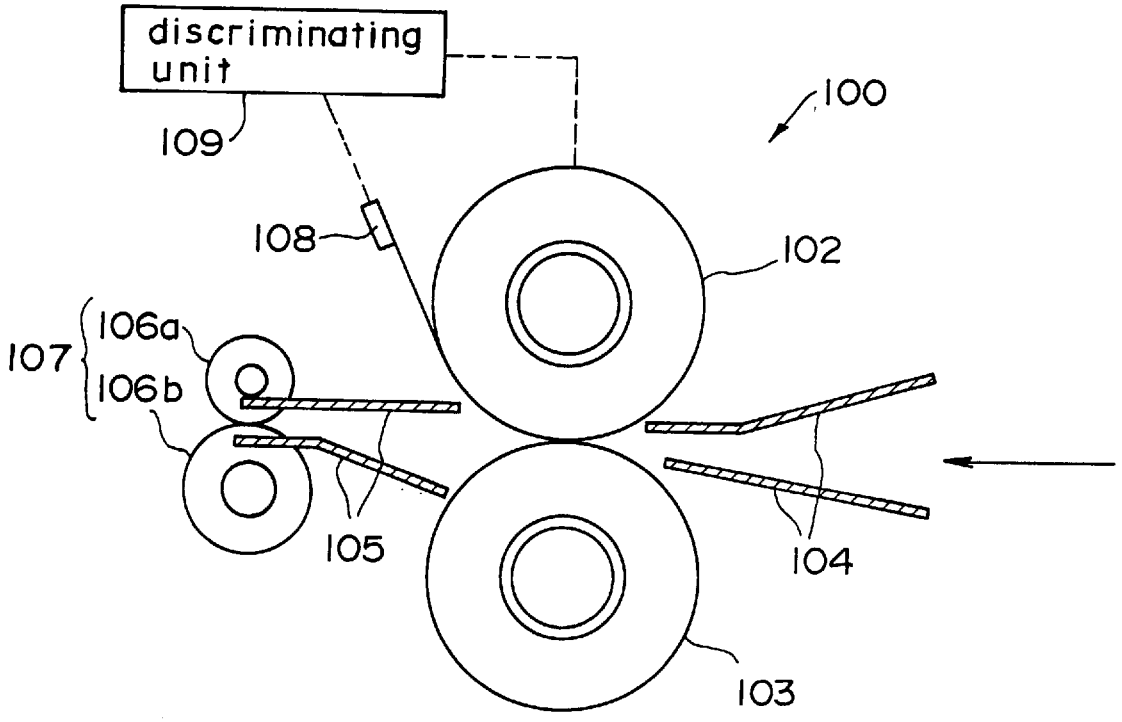
FIG. 2 is a side view showing the construction of the fixing device of the present invention.
Figure 3:
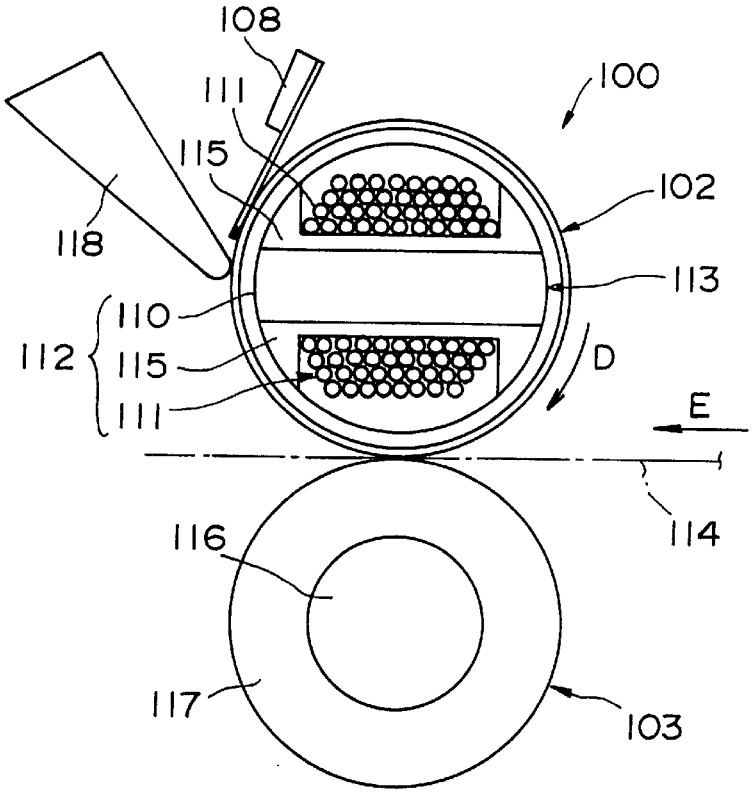
FIG. 3 illustrates the internal construction of the fixing roller of the fixing device of the present invention.

FIG. 2 is a side view showing the detailed construction of fixing device 100 of the present invention. FIG. 3 shows the internal construction of fixing roller 102 of fixing device 100.

Fixing device 100 is a device which heats and melts the toner transferred onto the sheet and fixes the same onto the sheet. Fixing device 100 comprises a fixing roller 102 as a first rotating member, and a pressure roller 103 as a second rotating member which presses against said fixing roller 102, as shown in FIG. 2.

Fixing device 100 is provided with guide members 104 to insert the sheet into fixing device 100 on the upstream side in the sheet transport direction (i.e., the arrow direction in FIG. 2), and discharge members 105 to eject the sheet on the downstream side in the sheet transport direction, as shown in FIG. 2. A sheet discharge device 107 comprising two discharge rollers 106*a* and 106*b* in mutual contact one with another is arranged on the downstream side of the discharge members 105.

Fixing device 100 is further provided with a temperature sensor 108 as a temperature detector on the downstream side in the sheet transport direction, as shown in FIG. 2. This temperature sensor 108 communicates with a discriminating unit 109 comprising a microcomputer provided within the control unit of the copying machine (not illustrated), or within the fixing device controller which is connected to said control unit.

Fixing roller 102 is formed of a hollow, cylindrical metal member. Within fixing roller 102 is provided a holder unit 113 which accommodates a coil assembly 112 comprising a core 110 and a coil 111 wound around the core 110, as shown in FIG. 3. The metal fixing roller 102 is heated by the induction current of coil 111. Fixing roller 102 rotates in the arrow D direction in FIG. 3 via a drive mechanism (not illustrated) so as to drive pressure roller 103 in rotation therewith through their mutual contact. In this state, when a sheet 114 used as a recording medium moves in the arrow E direction so as to pass the nip area between fixing roller 102 and pressure roller 103, a toner image on said sheet 114 is heated and fused via the heat of fixing roller 102 and said fused toner image is subjected to pressure between rollers 102 and 103 so as to be fixed to said sheet 114.

The fixing roller 102 is desirably a strongly magnetic member formed of, for example, iron, nickel or the like. If fixing roller 102 is a strongly magnetic member, greater heating efficiency is achieved because the majority of magnetic flux passes through the interior of the fixing roller. A heat-resistant separation layer (not illustrated) formed of fluororesin may be provided on the exterior surface of fixing roller 102.

The coil assembly 112 comprises an insulated bobbin 115 arranged on the exterior surface of a core 110, and a coil 111 formed of copper wire wound around said bobbin 115. Bobbin 115 may be formed of, for example, ceramic material, or heat-resistant insulated engineering plastic. It is desirable that a single wire or a litz wire, provided with a fused layer and insulation layer on the surface thereof, is used as the aforesaid coil 111. The core 110 may be, for example; a laminate core formed of ferrite material.

The aforesaid coil assembly 112 functions as a heater to heat the fixing roller 102 by induction heating.

The pressure roller 103 comprises a silicon rubber layer 117 as a surface separation-type heat resistant rubber layer formed on the exterior surface of a core shaft 116, and bilateral ends of pressure roller 103 are provided with slide bearings not shown in the drawings. Pressure roller 103 is mounted so as to be freely rotatable on a fixing unit frame or the like (not shown) on the fixing device body and is pushed toward fixing roller 102 by a spring member or the like so as to be in a state of pressure contact therewith.

As shown in FIGS. 2 and 3, fixing roller 102 is provided with a temperature sensor 108 to detect the exterior surface temperature of the fixing roller 102. Temperature sensor 108 may be, for example, a thermistor. Temperature sensor 108 is arranged on the downstream side in the direction of sheet transport near the nip area between fixing roller 102 and pressure roller 103 to immediately detect temperature changes of fixing roller 102 due to the passage of sheet 114. In addition to a thermistor, a thermostat or temperature fuse may be used as a safety device against abnormal temperature elevation so as to block current to coil 111 when an abnormal temperature rise is detected.

As previously mentioned, temperature sensor 108 is connected to a discriminating unit 109 comprising a microcomputer or the like. Discriminating unit 109 determines the state of transport condition of sheet 114 in fixing device 100 based on the temperature change of fixing roller 102 detected by temperature sensor 108. Discriminating unit 109 prevents more severe blockage before they occur by stopping the operation of fixing device 100 when blockage such as a paper jam is determined to have occurred.

The relationship between the determination of the transport condition of sheet 114 by discriminating unit 109 and the temperature change of fixing roller 102 detected by temperature sensor 108 is described below with reference to FIG. 4.

Figure 4:
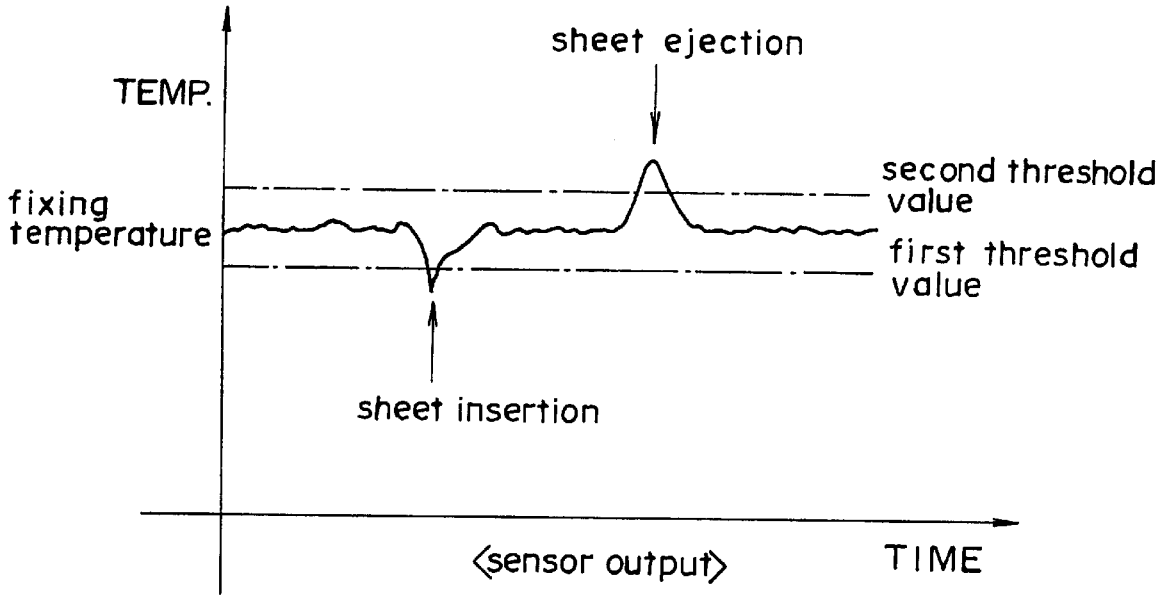
FIG. 4 is a time chart showing the relationship between the output of the temperature sensor and the transport timing of the recording medium.

FIG. 4 is a time chart showing the relationship between the transport timing of sheet 114 and the output of temperature sensor 108.

As can be understood from FIG. 4, the temperature of fixing roller 102 detected by temperature sensor 108 fluctuates slightly regardless of the presence of sheet 114. That is, the temperature of fixing roller 102 is regulated so as to stay within a predetermined range and maintains a slight amplitude. In this state, when a sheet 114 is inserted in fixing device 100 and comes into contact with fixing roller 102, the temperature of fixing roller 102 exhibits a marked temporary drop. Furthermore, when sheet 114 is ejected from within fixing device 100 so as to be separated from fixing roller 102, the temperature of fixing roller 102 exhibits a marked temporary rise.

A first threshold value is set at a value higher than the temperature drop when sheet 114 is inserted into fixing device 100 and at a value lower than the lowest limit of temperature fluctuation caused by normal temperature regulation of fixing roller 102, and a second threshold value is set at a value lower than the temperature rise when a sheet 114 is ejected from within fixing device 100 and at a value higher than the highest limit of temperature fluctuation caused by normal temperature regulation of fixing roller 102. Therefore, sheet insertion in fixing device 100 can be discriminated based on the detection of a temperature below the aforesaid first threshold value, and sheet ejection from fixing device 100 can be discriminated based on the detection of a temperature above the aforesaid second threshold value.

Since the temperature of fixing roller 102 normally fluctuates due to temperature regulation as previously mentioned, the first and second threshold values may change in accordance with said fluctuation.

The operation of fixing device 100 of the aforesaid construction is described below.

A sheet 114 bearing an unfixed toner image is transported from right to left in FIG. 2 (i.e., the arrow E direction in FIG. 3), arrives at guide members 104, and is fed toward the nip area between fixing roller 102 and pressure roller 103. This sheet 114 passes through the nip area under pressure from pressure roller 103 and heat from the heated fixing roller 102. The unfixed toner image is melted and fixed onto the sheet 114 via the aforesaid heat and pressure.

A sheet 114 which has passed through the nip area naturally separates from fixing roller 102, or the leading edge of sheet 114 is forcibly separated from fixing roller 102 by means of a separation member or separation guide 118 disposed so as to have the leading edge of said separation guide make sweeping contact with the surface of fixing roller 102 as shown in FIG. 4, said sheet 114 then arrives at discharge member 105 and is ejected to discharge tray 58 by discharge device 107.

While sheet 114 passes through fixing device 100, the temperature of fixing roller 102 is detected by temperature sensor 108. Discriminating unit 109 determines the transport state of sheet 114 in fixing device 100 based on the detected temperature change, and executes controls so as to stop the operation of fixing device 100 when a blockage such as a paper jam occurs.

The control content of discriminating unit 109 is described below with reference to FIG. 5.

Figure 5:
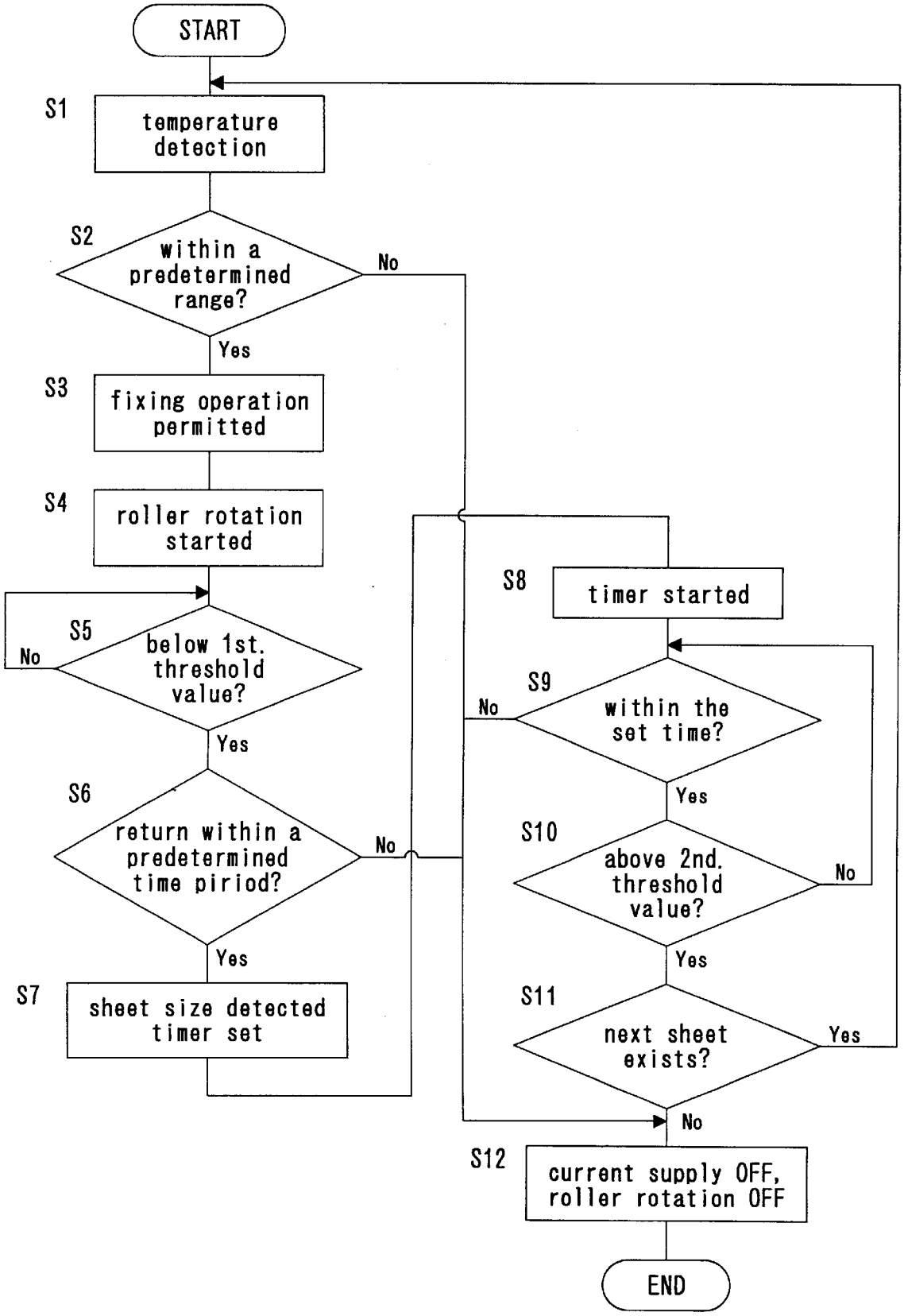
FIG. 5 is a flow chart showing the control content executed in the image forming apparatus of the present invention.

FIG. 5 is a flow chart showing the sequence of controls executed by discriminating unit 109.

When control starts, first the temperature of fixing roller 102 is detected by temperature sensor 108 (Step S1), and a determination is made as to whether or not the detected temperature is within a predetermined range (Step S2).

When the detected temperature exceeds the predetermined range (Step S2: NO), current is blocked to coil 111 of coil assembly 112 which heats fixing roller 102, and the rotation of fixing roller 102 is stopped (Step S12). Damage to fixing device 100 due to abnormal temperature rise is thereby prevented.

On the other hand, when the detected temperature of fixing roller 102 is within a predetermined range in step S2 (Step S2: YES), the fixed operation of fixing roller 100 is permitted (Step S3), and fixing roller 102 start to rotate (Step S4).

Then, dropping of the temperature detected by temperature sensor 108 to a temperature below the first threshold value is awaited (Step S5). When the temperature detected by temperature sensor 108 is determined to be below the first threshold value (Step S5: YES), then, a determination is made as to whether or not the detected temperature has returned to a temperature above said first threshold value within a predetermined time period (Step S6).

When the temperature of fixing roller 102 detected by temperature sensor 108 does not return to a temperature above the first threshold value within a predetermined time (Step S6: NO), it is determined that an abnormality (blockage) of the heating source coil assembly 112 etc. has occurred, and power to the coil 111 is interrupted and rotation of fixing roller 102 is stopped (Step S12).

On the other hand, when the detected temperature does return to a temperature above the first threshold value within a predetermined time period (Step S6: YES), it is determined that a sheet 114 has passed normally through fixing device 100, and the size of sheet 114 is detected and a time corresponding to said sheet size is set in a timer (Step S7). The set time is the time required for sheet 114 to pass through fixing device 100.

Then, the timer is started (Step S8), and when the set time of the timer elapses (Step S9: NO) before the temperature of fixing roller 102 detected by temperature sensor 108 attains a temperature above the second threshold value (Step S10: NO), a paper jam is determined to have occurred within fixing device 100, and current is interrupted to coil 111 which heats fixing roller 102 and the rotation of fixing roller 102 is stopped (Step S12). The operation of the fixing device 100 is immediately stopped when a blockage such as a paper jam occurs in fixing device 100. Therefore, a severe blockage caused by ignoring a simple blockage condition and blockages that cannot be cleared by a user are prevented. Furthermore, a condition is avoided wherein the image forming apparatus is temporarily out of service during the time until a technician with special skills can arrive to clear the serious blockage caused by a paper jam or the like.

On the other hand, when the temperature of fixing roller 102 detected by temperature sensor 108 attains a temperature above a second threshold value (Step S10: YES) before the set time of the timer has elapsed (Step 9: YES), it is determined that a sheet 114 has passed normally through fixing device 100, and the routine continues to the next step. A determination is made as to whether or not there is a next sheet to be fixed (Step S11). If there is a next sheet to be fixed (Step S11: YES), the routine returns to step S1 and the previously described processes are repeated. If there is not a next sheet to be fixed (Step S11: NO), the current to coil 111 and the rotation of fixing roller 102 are stopped (Step S12), and the process ends.

In the copying machine and fixing device of the embodiment described above, the insertion of a sheet into the fixing device and its ejection therefrom are detected by using a detector to detect the temperature of the fixing roller of the fixing device and, since a separate sheet detection sensor is not required, the number of parts and cost of the apparatus are reduced. Fixing devices which accomplish fixing by means of heat generally are provided with temperature detectors to regulate the temperature of a first rotating member, i.e., a heating member.

Sheet detection in the mode described above can be accomplished with high precision without affecting the heating of the fixing device.

Although the present invention has been fully described in connection with the preferred embodiments thereof with reference to the accompanying drawings, it is to be noted that various changes and modifications are apparent to those skilled in the art. Such changes and modifications are to be understood as being included within the scope of the present invention as defined by the appended claims unless they depart therefrom.

For example, although a full color copier was used as an example of an image forming apparatus in the embodiments described above, the invention may be applied to other image forming apparatuses such as printers, facsimile machines and the like. Furthermore, the present invention is not only applicable to full color image forming apparatuses, but is also applicable to monochrome image forming apparatuses, and likewise is applicable not only to digital image forming apparatuses, but also analog type image forming apparatuses.

Although a hollow cylindrical fixing roller was used as an example as a first rotating member in the embodiments described above, it is to be noted that alternatively a flexible sleeve, belt or the like member using a thin metal layer may be used.

In the previously described embodiments, a first rotating member comprising a fixing roller is heated by induction heating, but it is to be understood that the method of heating the first rotating member is not limited to this method inasmuch as various alternative methods may be used.

What is claimed is:

1. An image forming apparatus comprising:

a fixing device which heats and melts unfixed toner borne on a sheet and fixes said toner onto said sheet, said fixing device being provided with, 1) a first rotating member which is freely rotatable, 2) a second rotating member which is freely rotatable and presses against said first rotating member to nip and transport said sheet between said first and second rotating members, and 3) a heater which heats said first rotating member;

a detector which detects the temperature of said first rotating member; and a discriminating unit for determining the insertion and the ejection of said sheet in said fixing device based on the temperature of said first rotating member detected by said detector.

2. The image forming apparatus as claimed in claim 1, wherein said discriminating unit determines that said sheet has been inserted into said fixing device when the temperature of said first rotating member is less than a predetermined first threshold value, and determines that said sheet has been ejected from said fixing device when the temperature of said first rotating member is greater than a predetermined second threshold value which is greater than said first threshold value.

3. The image forming apparatus as claimed in claim 2, wherein said discriminating unit also determines a paper jam has occurred when said sheet has not been determined to have been ejected from said fixing device within a predetermined time after said sheet has been determined to have been inserted in said fixing device.

4. The image forming apparatus as claimed in claim 3, wherein said discriminating unit controls said fixing device to be stopped when the paper jam is determined.

5. The image forming apparatus as claimed in claim 1, wherein said detector is a thermistor which detects the surface temperature of said first rotating member.

6. The image forming apparatus as claimed in claim 1, wherein said detector is disposed near the area of contact between said first and second rotating members on the downstream side therefrom in the sheet transport direction.

7. The image forming apparatus as claimed in claim 1, wherein said first rotating member is a roller.

8. The image forming apparatus as claimed in claim 1, wherein said heater is built into said first rotating member.

9. A fixing device for heating and melting unfixed toner borne on a sheet and fixing said toner onto said sheet, said fixing device comprising:

a first rotating member which is freely rotatable;

a second rotating member which is freely rotatable and presses against said first rotating member to nip and transport said sheet between said first and second rotating members;

a heater which heats said first rotating member;

a detector which detects the temperature of said first rotating member; and a discriminating unit for determining the insertion and the ejection of said sheet in said fixing device based on the temperature of said first rotating member detected by said detector.

10. The fixing device as claimed in claim 9, wherein said discriminating unit determines that said sheet has been inserted into said fixing device when the temperature of said first rotating member is less than a predetermined first threshold value, and determines that said sheet has been ejected from said fixing device when the temperature of said first rotating member is greater than a predetermined second threshold value which is greater than said first threshold value.

11. The fixing device as claimed in claim 10, wherein said discriminating unit also determines a paper jam has occurred when said sheet has not been determined to have been ejected from said fixing device within a predetermined time after said sheet has been determined to have been inserted in said fixing device.

12. The fixing device as claimed in claim 11, wherein said discriminating unit controls said fixing device to be stopped when the paper jam is determined.

13. The fixing device as claimed in claim 9, wherein said detector is a thermistor which detects the surface temperature of said first rotating member.

14. The fixing device as claimed in claim 9, wherein said detector is disposed near the area of contact between said first and second rotating members on the downstream side therefrom in the sheet transport direction.

15. The image forming apparatus as claimed in claim 9, wherein said first rotating member is a roller.

16. The image forming apparatus as claimed in claim 9, wherein said heater is built into first rotating member.

17. An image forming apparatus having a fixing device that heats and melts unfixed toner borne on a sheet and fixes said toner onto said sheet, said fixing device comprising:

a first rotating member that is freely rotatable;

a second rotating member that is freely rotatable and that presses against said first rotating member to nip and transport said sheet between said first and second rotating members;

a heater that heats said first rotating member;

a detector that detects the temperature of said first rotating member; and a discriminating unit for determining when said sheet has been inserted in said fixing device based on the temperature of said first rotating member detected by said detector.

18. The image forming apparatus as claimed in claim 17, wherein said discriminating unit determines that said sheet has been inserted into said fixing device when the temperature of said first rotating member is less than a predetermined threshold value.

19. The image forming apparatus as claimed in claim 18, wherein said discriminating unit also determines when a paper jam has occurred when said sheet has not been determined to have been ejected from said fixing device within a predetermined time after said sheet has been determined to have been inserted in said fixing device.

20. The image forming apparatus as claimed in claim 19, wherein said discriminating unit stops said fixing device when a the paper jam is determined.

21. The image forming apparatus as claimed in claim 17, wherein said detector is a thermistor that detects the surface temperature of said first rotating member.

22. The image forming apparatus as claimed in claim 17, wherein said detector is disposed near the area of contact between said first and second rotating members on the downstream side therefrom in the sheet transport direction.

23. The image forming apparatus as claimed in claim 17, wherein said first rotating member is a roller.

24. The image forming apparatus as claimed in claim 17, wherein said heater is built into said first rotating member.

25. An image forming apparatus having a fixing device that heats and melts unfixed toner borne on a sheet and fixes said toner onto said sheet, said fixing device comprising:

a first rotating member that is freely rotatable;

a second rotating member that is freely rotatable and that presses against said first rotating member to nip and transport said sheet between said first and second rotating members;

a heater that heats said first rotating member;

a detector that detects the temperature of said first rotating member; and a discriminating unit for determining when said sheet has been ejected from said fixing device based on the temperature of said first rotating member detected by said detector.

26. The image forming apparatus as claimed in claim 25, wherein said discriminating unit determines that said sheet has been ejected from said fixing device when the temperature of said first rotating member is greater than a predetermined threshold value.

27. The image forming apparatus as claimed in claim 26, wherein said discriminating unit also determines when a paper jam has occurred when said sheet has not been determined to have been ejected from said fixing device within a predetermined time after having been inserted in said fixing device.

28. The image forming apparatus as claimed in claim 27, wherein said discriminating unit stops said fixing device when a the paper jam is determined.

29. The image forming apparatus as claimed in claim 25, wherein said detector is a thermistor that detects the surface temperature of said first rotating member.

30. The image forming apparatus as claimed in claim 25, wherein said detector is disposed near the area of contact between said first and second rotating members on the downstream side therefrom in the sheet transport direction.

31. The image forming apparatus as claimed in claim 25, wherein said first rotating member is a roller.

32. The image forming apparatus as claimed in claim 25, wherein said heater is built into said first rotating member.

33. A fixing device for heating and melting unfixed toner borne on a sheet and fixing said toner onto said sheet, said fixing device comprising:

a first rotating member that is freely rotatable;

a second rotating member that is freely rotatable and that presses against said first rotating member to nip and transport said sheet between said first and second rotating members;

a heater that heats said first rotating member;

a detector that detects the temperature of said first rotating member; and a discriminating unit for determining when said sheet has been inserted in said fixing device based on the temperature of said first rotating member detected by said detector.

34. The fixing device as claimed in claim 33, wherein said discriminating unit determines that said sheet has been inserted into said fixing device when the temperature of said first rotating member is less than a predetermined threshold value.

35. The fixing device as claimed in claim 34, wherein said discriminating unit also determines when a paper jam has occurred when said sheet has not been determined to have been ejected from said fixing device within a predetermined time after said sheet has been determined to have been inserted in said fixing device.

36. The fixing device as claimed in claim 35, wherein said discriminating unit stops said fixing device when a the paper jam is determined.

37. The fixing device as claimed in claim 33, wherein said detector is a thermistor that detects the surface temperature of said first rotating member.

38. The fixing device as claimed in claim 33, wherein said detector is disposed near the area of contact between said first and second rotating members on the downstream side therefrom in the sheet transport direction.

39. The fixing device as claimed in claim 33, wherein said first rotating member is a roller.

40. The fixing device as claimed in claim 33, wherein said heater is built into said first rotating member.

41. A fixing device for heating and melting unfixed toner borne on a sheet and fixing said toner onto said sheet, said fixing device comprising:

a first rotating member that is freely rotatable;

a second rotating member that is freely rotatable and that presses against said first rotating member to nip and transport said sheet between said first and second rotating members;

a heater that heats said first rotating member;

a detector that detects the temperature of said first rotating member; and a discriminating unit for determining when said sheet has been ejected from said fixing device based on the temperature of said first rotating member detected by said detector.

42. The fixing device as claimed in claim 41, wherein said discriminating unit determines that said sheet has been ejected from said fixing device when the temperature of said first rotating member is greater than a predetermined threshold value.

43. The fixing device as claimed in claim 42, wherein said discriminating unit also determines when a paper jam has occurred when said sheet has not been determined to have been ejected from said fixing device within a predetermined time after having been inserted in said fixing device.

44. The fixing device as claimed in claim 43, wherein said discriminating unit stops said fixing device when a the paper jam is determined.

45. The fixing device as claimed in claim 41, wherein said detector is a thermistor that detects the surface temperature of said first rotating member.

46. The fixing device as claimed in claim 41, wherein said detector is disposed near the area of contact between said first and second rotating members on the downstream side therefrom in the sheet transport direction.

47. The fixing device as claimed in claim 41, wherein said first rotating member is a roller.

48. The fixing device as claimed in claim 41, wherein said heater is built into said first rotating member.

49. A method of detecting the passage of a sheet between a pair of rotating members, comprising the steps of:

inserting a sheet between a first rotating member and a second rotating member, wherein said sheet is transported between said first rotating member and said second rotating member and ejected from between said first rotating member and said second rotating member;

heating said first rotating member or said second rotating member;

detecting the temperature of the heated rotating member; and determining when the sheet is inserted and ejected based on the detected temperature.

50. The method as claimed in claim 49, wherein the step of determining determines that said sheet has been inserted when the temperature of said first rotating member is less than a predetermined first threshold value, and determines that said sheet has been ejected when the temperature of said first rotating member is greater than a predetermined second threshold value that is greater than said first threshold value.

51. The method as claimed in claim 50, wherein the step of determining also determines when a paper jam has occurred when said sheet has not been ejected.

52. The method as claimed in claim 51, further comprising the step of:

stopping the rotation of the first and second members when the paper jam is determined.

53. The method as claimed in claim 49, wherein the temperature of the heated rotating member is detected by a thermistor, which detects the surface temperature of said heated rotating member.

54. The method as claimed in claim 49, wherein the temperature of the heated rotating member is detected near the area of contact between said first and second rotating members on the downstream side therefrom in the sheet transport direction.

55. The method apparatus as claimed in claim 49, wherein said first rotating member is a roller.

56. The method as claimed in claim 49, wherein a heater is built into said heated rotating member.

57. A method of detecting the insertion of a sheet between a pair of rotating members, comprising the steps of:

inserting a sheet between a first rotating member and a second rotating member for transporting said sheet between said first rotating member and said second rotating member;

heating said first rotating member or said second rotating member; detecting the temperature of the heated rotating member; and determining when the sheet is inserted and ejected based on the detected temperature.

58. The method as claimed in claim 57, wherein the step of determining determines that said sheet has been inserted when the temperature of the heated rotating member is less than a predetermined first threshold value.

59. The method as claimed in claim 58, wherein the step of determining also determines when a paper jam has occurred when said sheet has not been ejected.

60. The method as claimed in claim 59, further comprising the step of:

stopping the rotation of the first and second members when the paper jam is determined.

61. The method as claimed in claim 57, wherein the temperature of the heated rotating member is detected by a thermistor, which detects the surface temperature of said heated rotating member.

62. The method as claimed in claim 57, wherein the temperature of the heated rotating member is detected near the area of contact between said first and second rotating members on the downstream side therefrom in the sheet transport direction.

63. The method apparatus as claimed in claim 57, wherein said first rotating member is a roller.

64. The method as claimed in claim 57, wherein a heater is built into the heated rotating member.

65. A method of detecting the ejection of a sheet from between a pair of rotating members, comprising the steps of:

inserting a sheet between a first rotating member and a second rotating member for transporting said sheet between said first rotating member and said second rotating member;

ejecting a sheet from between said first rotating member and said second rotating member;

heating said first rotating member or said second rotating member; detecting the temperature of the heated rotating member; and determining when the sheet is ejected based on the detected temperature.

66. The method as claimed in claim 65, wherein the step of determining determines that said sheet has been ejected when the temperature of the heated rotating member is greater than a predetermined first threshold value.

67. The method as claimed in claim 66, wherein the step of determining also determines when a paper jam has occurred when said sheet has not been ejected.

68. The method as claimed in claim 67, further comprising the step of:

stopping the rotation of the first and second members when the paper jam is determined.

69. The method as claimed in claim 65, wherein the temperature of the heated rotating member is detected by a thermistor, which detects the surface temperature of the heated rotating member.

70. The method as claimed in claim 65, wherein the temperature of the heated rotating member is detected near the area of contact between said first and second rotating members on the downstream side therefrom in the sheet transport direction.

71. The method apparatus as claimed in claim 65, wherein said first rotating member is a roller.

72. The method as claimed in claim 65, wherein a heater is built into the heated rotating member.

* * * * *